US007418947B2

(12) United States Patent
Gottlieb et al.

(10) Patent No.: US 7,418,947 B2
(45) Date of Patent: Sep. 2, 2008

(54) DIRECT INJECTION VALVE IN A CYLINDER HEAD

(75) Inventors: Bernhard Gottlieb, München (DE); Andreas Kappel, Brunnthal (DE); Tim Schwebel, München (DE)

(73) Assignee: Siemens Aktiengesellschaft, Munich (DE)

( * ) Notice: Subject to any disclaimer, the term of this patent is extended or adjusted under 35 U.S.C. 154(b) by 88 days.

(21) Appl. No.: 11/235,025

(22) Filed: Sep. 26, 2005

(65) Prior Publication Data

US 2006/0157034 A1 Jul. 20, 2006

Related U.S. Application Data

(63) Continuation of application No. PCT/EP2004/003082, filed on Mar. 23, 2004.

(30) Foreign Application Priority Data

Mar. 27, 2003 (DE) ..... 103 13 836

(51) Int. Cl.
*F02M 53/04* (2006.01)

(52) U.S. Cl. ..... 123/468

(58) Field of Classification Search ..... 123/468–470, 123/478–498, 490; 277/591–599, 313, 132; 239/132
See application file for complete search history.

(56) References Cited

U.S. PATENT DOCUMENTS

| | | | | |
|---|---|---|---|---|
| 2,264,914 A | | 12/1941 | L'Orange | 299/107.1 |
| 3,612,012 A | * | 10/1971 | Dreisin | 123/41.31 |
| 3,841,277 A | * | 10/1974 | Schafer | 123/470 |
| 4,133,321 A | * | 1/1979 | Hofmann et al. | 123/470 |
| 5,706,787 A | * | 1/1998 | Fujikawa | 123/470 |
| 6,119,658 A | | 9/2000 | Jehle et al. | 123/470 |
| 6,186,123 B1 | | 2/2001 | Maier et al. | 123/470 |
| 6,196,195 B1 | | 3/2001 | Trutschel et al. | 123/470 |
| 6,427,667 B1 | * | 8/2002 | Kato | 123/470 |
| 6,460,512 B1 | * | 10/2002 | Serio | 123/470 |
| 6,478,013 B1 | * | 11/2002 | Boecking | 123/467 |
| 6,499,468 B1 | * | 12/2002 | Ferraro et al. | 123/470 |

(Continued)

FOREIGN PATENT DOCUMENTS

DE 873 011 4/1953

(Continued)

OTHER PUBLICATIONS

Kuchling, Horst: Taschenbuch der Physik. 12. Auflage. Verlag Harri Deutsch. Thun und Frankfurt/Main, 1989. ISBN: 3 8171 1020 0, 2 pages, Nov. 15, 1988.

(Continued)

*Primary Examiner*—M. McMahon
(74) *Attorney, Agent, or Firm*—Baker Botts L.L.P.

(57) ABSTRACT

A direct injection valve in a cylinder head (1) consists of a cylindrical housing comprising the following components: a valve (16) for dosing a fluid by means of a valve needle (15), an actuator (2) for generating a stroke acting on the valve needle, and a fluid supply to the valve (16). In order to minimise the heat transfer from the cylinder head (1) to the injection valve, an air gap (3) surrounds the housing of the injection valve, maintaining the housing and the cylinder head at a distance from each other.

10 Claims, 4 Drawing Sheets

U.S. PATENT DOCUMENTS

| | | | | |
|---|---|---|---|---|
| 6,866,026 | B2 * | 3/2005 | Mickelson | 123/470 |
| 2002/0148446 | A1 | 10/2002 | Gmelin | 123/470 |
| 2002/0152995 | A1 * | 10/2002 | Kato | 123/470 |
| 2003/0132322 | A1 * | 7/2003 | Dantes et al. | 239/585.1 |
| 2005/0017096 | A1 | 1/2005 | Bachmaier et al. | 239/584 |
| 2005/0103587 | A1 | 5/2005 | Fischer et al. | 188/297 |
| 2005/0247803 | A1 * | 11/2005 | Liskow | 239/102.2 |

FOREIGN PATENT DOCUMENTS

| | | | |
|---|---|---|---|
| DE | 3623221 | C2 | 2/1988 |
| DE | 197 35 665 | A1 | 1/1999 |
| DE | 197 43 103 | A1 | 4/1999 |
| DE | 198 08 068 | A1 | 9/1999 |
| DE | 198 38 755 | A1 | 3/2000 |
| EP | 0 961 025 | A1 | 12/1999 |
| EP | 0 982 493 | A1 | 3/2000 |
| FR | 1 089 892 | | 3/1955 |
| JP | 09310660 | | 2/1997 |
| WO | 03/016707 | | 2/2003 |
| WO | 03/085253 | A1 | 10/2003 |
| WO | 03/089781 | A1 | 10/2003 |
| WO | 2004/085828 | A3 | 10/2004 |

OTHER PUBLICATIONS

PCT International Search Report Application No. PCT/EP2004/003082 , 8 pages, 2004.

* cited by examiner

DIRECT INJECTION VALVE IN A CYLINDER HEAD

CROSS-REFERENCE TO RELATED APPLICATIONS

This application is a continuation of co-pending International Application No. PCT/EP2004/003082 filed Mar. 23, 2004, which designates the United States of America, and claims priority to German application number 10313836.6 filed Mar. 27, 2003, the contents of which are hereby incorporated by reference in their entirety.

TECHNICAL FIELD

The invention is related to a direct injection valve in a cylinder head.

BACKGROUND

Valves/injectors injecting directly in the combustion chamber are positioned low down in the cylinder head near the combustion chamber. Because high temperatures are generated by the combustion process implemented near the injector and a considerable heat is efficiently conducted by the metallic cylinder head, the immediate environment of the injection valve in the cylinder head reaches high temperatures of up to approximately 150° C. In racing car engines, it is possible that even higher temperatures of up to 200° C. are reached in extreme cases. Designing an injector for such high temperatures so that said injector is not damaged or destroyed has not been provided until now. In addition, the removal of dissipated heat generated inside the injector has to be taken into consideration.

Until now, the heat carried from the cylinder head to the injector has not been taken into consideration. Measures used until now for efficient thermal contact to the outside in order to remove the dissipation power of the actuator drive, consist of a corresponding cooling by the fuel flow.

As effective measures for this, for example, the double-layer injector assembly, in accordance with the patent application PCT 02/02928 and the improved thermal contact of a solid actuator to the fuel flow as described in the German patent applications with the official application number DE-10217882 or DE-10214931, are used.

SUMMARY

The object of the invention is to create an effective, thermal insulation of the injector against the hotter cylinder head in order to be able to use direct injection valves in ever increasingly powerful production model engines and in racing car engines with a considerably higher thermal load.

The object of the invention can be achieved by a direct injection valve in a cylinder head, having a cylindrical housing comprising the following components: a valve aligned in the direction of a combustion chamber for dosing a fluid by means of a valve needle, an actuator for generating a stroke acting on the valve needle, and a fluid supply from the back of the actuator to the valve, wherein in order to minimize the heat transfer from the cylinder head to the injection valve, an air gap surrounds the injection valve and keeps it at a relative distance from the cylinder head.

The fluid supply can be distributed evenly cross the circumference in the radial outer area of the direct injection valve. The air gap can be filled with one gas or a plurality of gases whose thermal conductivity is lower than that of air. The housing of the direct injection valve can be positioned concentrically in the front and rear area and/or sealed hermetically by seals relative to an installation space in the cylinder head. The air gap can be greater than 1 mm. The surface of a valve fitted in the combustion chamber in order to minimize the quantity of heat absorbed from the combustion chamber, can be polished and/or made of a material with a low degree of emission $\epsilon$.

The object can also be achieved by a direct injection valve in a cylinder head, having a cylindrical housing comprising the following components: a valve aligned in the direction of a combustion chamber for dosing a fluid by means of a valve needle, an actuator for generating a stroke acting on the valve needle, and a fluid supply from the back of the actuator to the valve, wherein in order to minimize the heat transfer from the cylinder head to the injection valve, surfaces associated with radiation are made of a material with a low degree of emission $\epsilon$.

The fluid supply can be distributed evenly cross the circumference in the radial outer area of the direct injection valve. At least one surface associated with radiation may consist of nickel. At least one surface associated with radiation can be coated with gold. The surface of a valve fitted in the combustion chamber in order to minimize the quantity of heat absorbed from the combustion chamber, can be polished and/or made of a material with a low degree of emission $\epsilon$.

The object can further be achieved by a direct injection valve in a cylinder head, having a cylindrical housing comprising the following components: a valve aligned in the direction of a combustion chamber for dosing a fluid by means of a valve needle, an actuator for generating a stroke acting on the valve needle, and a fluid supply from the back of the actuator to the valve, wherein in order to minimize the heat transfer from the cylinder head to the injection valve, metal-to-metal contact areas are separated from each other by means of an insulating material.

The fluid supply can be distributed evenly cross the circumference in the radial outer area of the direct injection valve. The insulating material may consist of an insulating disc with a thickness of at least 0.5 mm. The insulating disc may have a thickness of between 2 and 5 mm. The insulating disc can be resistant to a temperature of at least up to 220° C. The insulating disc can be resistant to corrosion, may have a minimum thickness and may not flow. The insulating disc may consist of one of the materials such as hard rubber, hard paper, polyamide, polytetrafluoroethylene (PTFE), epoxy resin or a compound such as synthetic materials reinforced with carbon fibers or glass fibers. The surface of a valve fitted in the combustion chamber in order to minimize the quantity of heat absorbed from the combustion chamber, can be polished and/or made of a material with a low degree of emission $\epsilon$.

A solution is, thus, based on the finding that in order to improve the thermal insulation (cooling) of the injection valve, the design of the injector installation space in the cylinder head has to be embodied in such a way that an air gap surrounds the housing of the injector; said air gap positioned between the outside surface of the injector and the inside surface of the installation space in the cylinder-head. It is possible that sealing elements protect this air gap against contamination.

An additional solution consists in reducing the heat irradiated from the cylinder head to the direct injector by reducing the degree of emission $\epsilon$ from radiating surfaces of the cylinder head and/or the injection valve. This can be achieved when the injector surfaces associated with radiation and/or the installation space in the cylinder head, for example, are represented by a surface coating consisting of a material, which has a low degree of emission $\epsilon$.

In addition, the heat conductance at the only remaining metal-to-metal contact is minimized on the front side of the injector. The means for this is an insulating disc, which is placed in between and acts as heat insulation.

All in all, these measures ensure that for the injector drive, under all the relevant operating conditions, there is always sufficient cooling by the fuel flowing through the injector and that its drive is not destroyed by overheating.

An advantageous embodiment of the invention is provided by the sealing of the air gap between a direct injection valve and the wall of the installation space in the cylinder head, in which case it is also advantageous to position the injector concentrically and/or to seal it hermetically.

The fluid supply to the injector is optimal if it is distributed evenly cross the circumference in the radial outer area of the direct injection valve, i.e. represents a by-pass flow.

In order to reduce the heat transfer by radiation, the surfaces associated with radiation can be coated easily and reliably with nickel.

An insulating disc with a thickness of approximately 2 to 5 mm with a corresponding resistance against high temperatures and corrosion considerably reduces the heat transfer by means of heat conductance compared to a metal-to-metal contact and, in addition, absorbs vibrations from the engine acting on the injector.

BRIEF DESCRIPTION OF THE DRAWINGS

Embodiments of the invention are explained below on the basis of the accompanying drawings and non-restricting figures. They are as follows.

DETAILED DESCRIPTION

Figure 1:
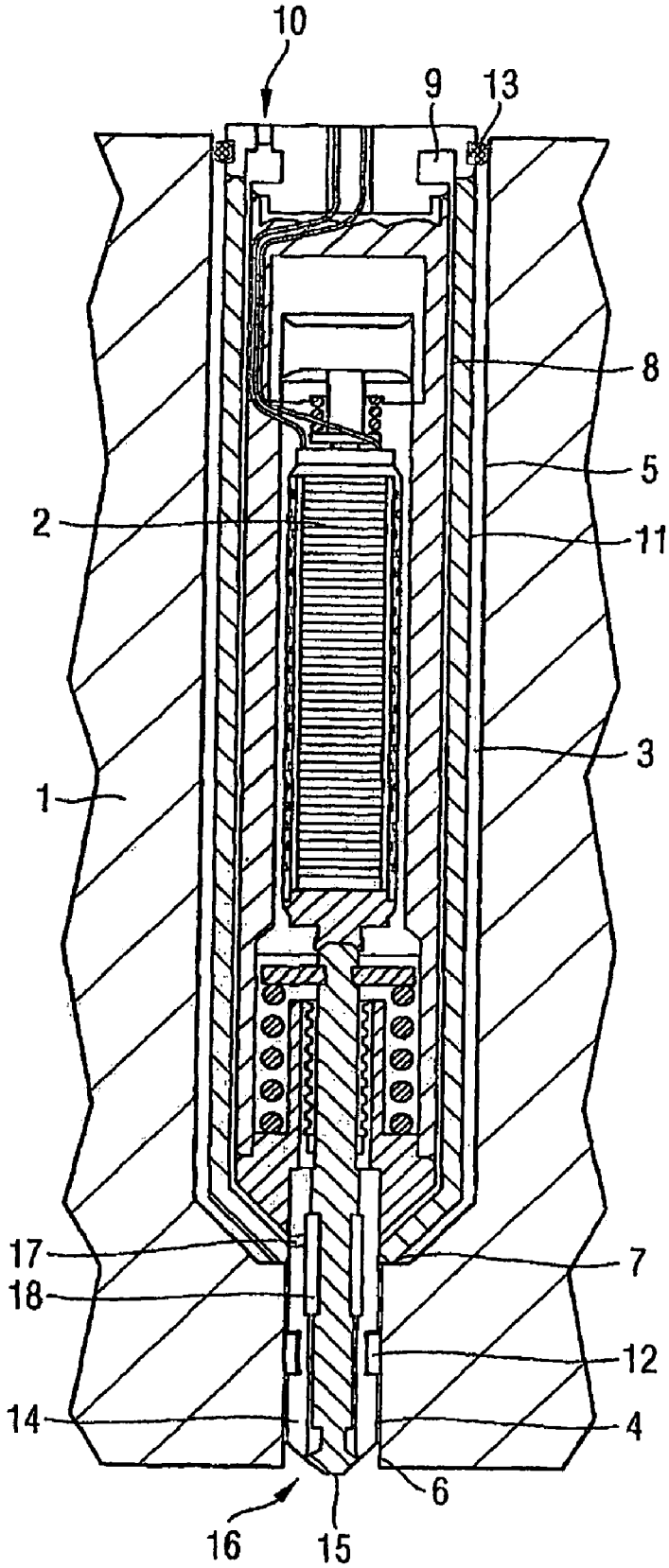
FIG. 1 shows an installation situation of a direct injection valve in a cylinder head with an insulating air gap.

FIG. 1 shows the installation situation of a piezoelectric direct injection valve. In the cylinder head 1, there is a suitably shaped bore, which is embodied with a larger diameter in its top part 5 and tapers towards the bottom part 6. The cross-section gap 7 forms the contact surface of the injector. With the exception of the contact surface, the bore dimensions are selected in such a way that there is no direct metal-to-metal contact between the outside contour 11 of the injector housing and the inside contour of the upper bore 5 of the cylinder head 1. On the contrary, an air gap 3, 4 is provided for thermal insulation in the top part 5 and in the bottom part 6 of the bore between the cylinder head 1 and the outside contour of the injector. The concentric positioning of the outside contour of the injector relative to the inside wall of the bore in the cylinder head 1 is actually ensured in the bottom bore part 6 by the combustion chamber seal 12 and in the top part 5, for example, by a suitably dimensioned seal ring 13. In addition, the seal 13 ensures that on handling the injector and on installation, no undesired fluid or solid substances fill the air gap 3, 4 and form a heat bridge in this way.

The fuel entering via the inlet 10 is distributed evenly across the circumference by using an annular groove 9, inserted into the cylindrical ring slot 8 and guided to the injector tip. The fuel reaches the inside of the injector tip via bores 17. Inside the injector tip, the fuel flows into the cavity 18, which is restricted by the valve needle 15 and the sleeve 14. The fuel flow, in its path from the inlet 10 up the outlet from the valve 16 formed by the valve needle 15 and the cartridge 14, efficiently absorbs both the heat carried in the cylinder head 1 and the dissipated heat generated by the specific drive and in doing so becomes warmer.

The air gap 3 is suitably dimensioned if the heat carried in the cylinder head 1 remains as low as possible so that it only causes a temperature increase in the fuel of less than approximately 20 K. As a result, this ensures that the drive of the injector, which is in the inside of the injector, is efficiently cooled by the fuel by-pass flow circulating around it under all the operating conditions.

A direct injector is insulated in a thermally active way from the cylinder head 1 by an encompassing air gap 3 having a gap width d=1 mm. The following appraisal for the worst-case scenario of the heat flow from the cylinder head 1 to the injector is now shown and compared in a) for a production model engine and in b) for a racing car engine:

Assumptions for the Most Negative Extreme Case:

The injector is approximated by a cylinder area through which the heat flow enters the injector. The fuel temperature on entering the injector is approximately 50° C. max. The surface area of the areas facing each other is approximately $8 \cdot 10^{-3}\ m^2$, Degree of absorption of emissions: $\epsilon$=0.35, in the case of a properly finished steel surface,

| | |
|---|---|
| Air gap: Average diameter | d = 20 mm, |
| Air gap: Average gap width | $\delta$ = 1 mm, |
| Stefan Boltzmann constants: | $\sigma = 5.67 \cdot 10^{-8}\ W/(m^2K^4)$ |
| Thermal conductivity of air: | $\lambda = 2.6 \cdot 10^{-3}\ W/(m^2K)$ |
| Heat capacity of fuel: | $C_m$ = 2240 Ws/(kgK) |

a.1) Production Model Engine with Air Gap:

The area of the injector facing the cylinder head is at fuel temperature.

The temperature of the side of the cylinder head facing the injector is 150° C.=423 K.

→ Heat input by radiation:

$$P_S=0.35\cdot 5.67\cdot 10^{-8}\cdot 8\cdot 10^{-3}\cdot(423^4-323^4)W=\underline{3.35W}$$

→ Heat input by heat conductance:

$$P_L=2.6\cdot 10^{-2}\cdot 8\cdot 10^{-3}\cdot(423-323)/(1.0\cdot 10^{-3})W=\underline{20.80W}$$

Total heat input: P=24.15W.

Assumption: Idle mode operation after a full throttle drive on the highway in which case the engine coasts.

Idle Mode Fuel Flow Per Cylinder:

$$dm/dt=0.2\cdot 10^{-3}\ kg/s.$$

Heating-Up of fuel:

$$P=Cm\cdot dm/dt\cdot\Delta T\rightarrow\Delta T=24.15/(2240\cdot 0.2\cdot 10^{-3})=\underline{53.9K}$$

Fuel final temperature: 103.9° C.

in the case of dm/dt=$0.2\cdot10^{-3}$ kg/s per injector;

approximately 4.1 l/h in the case of a 4-cylinder engine.

This is a peak temperature, which is never achieved in the case of the stationary load, but only in the non-stationary case on stopping after a full throttle drive.

a.2) Production Model Engine without Air Gap:

In this case, the heat flow from the cylinder head to the injector is only determined by the heat transfer coefficients γ from the injector wall to the fuel. γ=455 W/($m^2$K).

Without an air gap, the area which is in contact with the fuel is at cylinder head temperature $T_0$=150° C., Fuel inlet temperature: $T_F(0)$=50° C., Fuel mass flow:

$$dm/dt=0.2\cdot10^{-3}\text{ kg/s; approximately 2.16 l/h}$$

Transfer cylinder area:

Diameter: d=$18\cdot10^{-3}$ m, length l=0.127 m.

The temperature distribution in the fuel in the direction of flow, is as follows:

$$T_F(y)=T_0-(T_0-T_F(0)\cdot\exp(-\beta y)$$

$$\text{with } \beta=\gamma\pi d/(Cm\cdot dm/dt)\rightarrow\beta=57.43\text{ l/m}$$

→ at the fuel outlet:

$$T_F(0.127\text{ m})=150°\text{ C.}-150\text{K}\cdot\exp(-57.43\cdot0.127)=\underline{149.9°\text{C.}}$$

b.1) Racing Car Engine with Air Gap

The area of the injector facing the cylinder head is at fuel temperature.

The temperature of the side of the cylinder head facing the injector is 200° C.=473 K → Heat input by radiation:

$$P_S=0.35\cdot5.67\cdot10^{-8}\cdot8\cdot10^{-3}\cdot(473^4\cdot323^4)W=\underline{6.22\text{W}}$$

→ Heat input by heat conductance:

$$P_L=2.6\cdot10^{-2}\cdot8\cdot10^{-3}\cdot(473-323)/(1.0\cdot10^{-3})W=\underline{31.2\text{W}}$$

Total heat input: P=<u>37.42W</u>

Assumption: Idle mode operation after full-throttle drive; coasting of the engine.

Idle mode fuel flow: dm/dt=$\mathbf{0.3\cdot10^{-3}}$ kg/s

Heating-up of fuel:

$$P=Cm\cdot dm/dt\cdot\Delta T\rightarrow\Delta T=37.42/(2240\cdot0.3\cdot10^{-3})=\underline{55.7\text{K}}$$

Fuel final temperature: 106° C. at injector outlet.

b.2) Racing Car Engine without Air Gap

The heat flow from the cylinder head to the injector is only determined by the heat transfer coefficients γ from the injector wall to the fuel:

Approximately γ=520 W/($m^2$ K).

Without an air gap, the area which is in contact with the fuel is at cylinder head temperature $T_0$=200° C.

Fuel inlet temperature: $T_F(0)$=<u>50°C.</u>,

Fuel mass flow: dm/dt=$\mathbf{0.3\cdot10^{-3}}$ kg/s; approximately 2.16 l/h,

Transfer cylinder area:

Diameter: d=$18\cdot10^{-3}$ m, length l=0.127 m,

The temperature distribution in the fuel in the direction of flow, is as follows:

$$T_F(y)=T_0-(T_0-T_F(0)\cdot\exp(-\beta y)$$

$$\text{With } \beta=\gamma\pi d/(Cm\cdot dm/dt)\rightarrow\beta=43.76\text{ l/m}$$

→ at the fuel outlet:

$$T_F(0.127\text{ m})=200°\text{ C.}-150\text{K}\cdot\exp(-43.76\cdot0.127)=\underline{199.4°\text{C.}}$$

Figure 2:
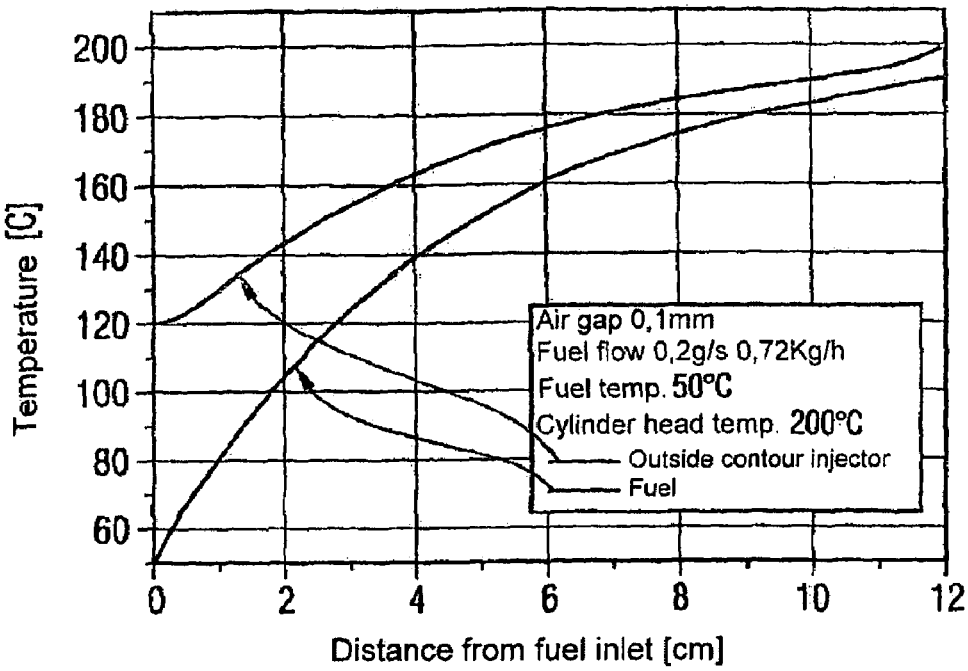
FIG. 2 shows the temperature curve within the injector, starting with the fuel inlet with a disappearing air gap with a width of only 0.1 mm.
Figure 3:
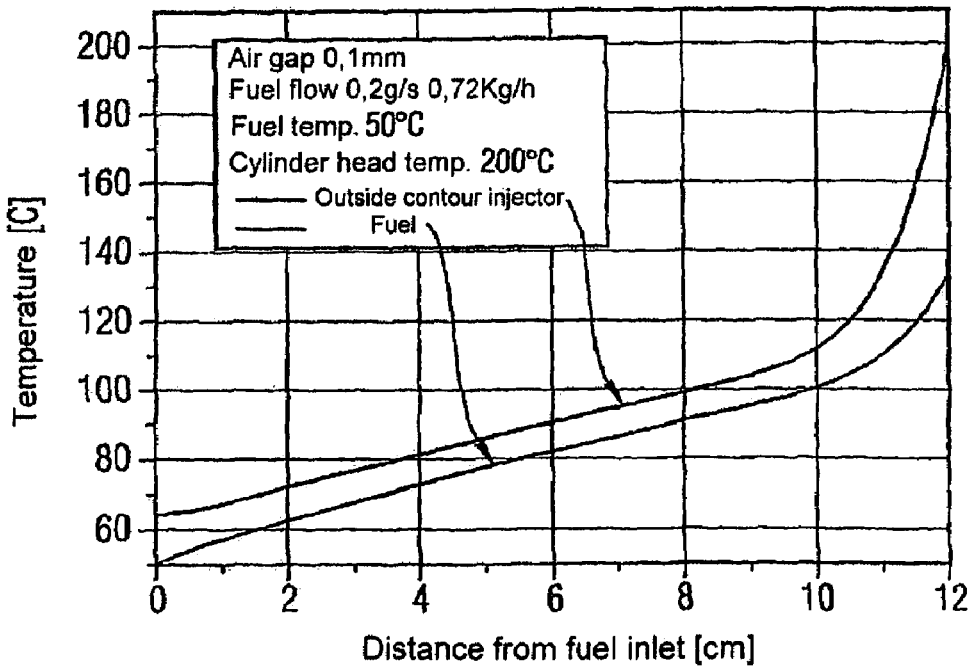
FIG. 3 shows the temperature curve within an injector with a sufficiently dimensioned air gap with a width of only 1.0 mm between the injector and the cylinder head.

The comparison of the simulation results for the fuel temperature in accordance with FIGS. 2 and 3 shows the necessity and the effectiveness of an air gap in order to reduce the fuel temperature and, because of this, an improved cooling at the injector drive. By correspondingly dimensioning the air gap, the requirements of the individual case can be taken into account.

The invention in the embodiment of the injector housing consists of an air gap 3, 4 between the outside contour of the injector 11 and the cylinder head; said air gap surrounding the housing of the injector. Sealing elements 12, 13 protect this air gap against contamination. In addition, metal-to-metal contact between the injector and the cylinder head is minimized. Furthermore, it is also possible to fill the gap with other insulating gases, which are better than air, or with solid bodies, which are poor conductors of heat. As a result, these measures ensure that:

Sufficient cooling by the fuel is always achieved for the injector drive under all the relevant operating conditions and the drive is not destroyed by overheating.

The valve tip projecting into the combustion chamber, in particular the valve seat, is cooled sufficiently. Because of this, a softening of the valve seat is avoided and its fatigue strength is achieved or increased.

Particularly in the case of high-performance engines, a considerable amount of heat is picked up in the injector in, for example, the hot soak phase by heat radiation. This can lead to extremely high temperatures in the injector. Until now, the heat carried from the cylinder head to the injector by heat radiation has not been taken into consideration.

FIG. 1 shows an installation situation of a piezoelectric direct injection valve. The installation space at a cylinder head 1 is shown by a suitably shaped bore, which accommodates the injector. The air gap 3 between the inside contour of the bore 5 and the outside contour 11 of the injector, serves to reduce the heat conductance from the cylinder head 1 to the injector. Under ideal conditions such as, for example, by a wide enough gap width, it is possible that the heat transfer is largely controlled in this area. In this case, the main heat transfer takes place by heat radiation via the surfaces associated with radiation between which a heat transfer by radiation takes place. Particularly, in the first minutes after a heavy-duty load phase, at present in the idle mode, for example, on stopping after having traveled on the highway, at a traffic light or on a hot soak, the cylinder head reaches maximum temperatures up to 150° C. (racing car engines up to 200° C.) while the direct injector should be kept at a predetermined fuel temperature level.

Assumptions for the Most Negative Extreme Case:

The injector is approximated by a cylinder area through which the heat flow enters the injector.

The surface area of the areas facing each other, i.e. area pairs associated with radiation, the outside contour of the injector 11 and the inside areas of the bores 5,6 is approximately $8\cdot10^{-3}$ $m^2$ in total.

Degree of emission: $\epsilon=0.35$
in the case of a properly finished steel surface,
Stefan Boltzmann constants: $\sigma=5.67\cdot10^{-8}$ W/(m$^2$K$^4$)

The fuel temperature on entering the injector is approximately 50°C. max.

The temperature of the side of the cylinder head 1 facing the injector is 200° C.=473 K → Heat input by radiation:

$$P_S=0.35\cdot5.67\cdot10-8\cdot8\cdot10^{-3}\cdot(4734-3234)W=\underline{6.22W}$$

Reducing the heat carried from the cylinder head to the injector is achieved by reducing the degree of emission $\epsilon$ of the bore surfaces in the cylinder head and/or the outside area of the injector 11 as well as the injector tip projecting into the combustion chamber.

By simply polishing the steel surface, $\epsilon=0.29$ can be achieved:

$$\rightarrow P_S=0.29\cdot5.67\cdot10^{-8}\cdot8.10^{-3}\cdot(4734-3234)W=\underline{5.15W}$$

By simply coating, for example, with nickel, an $\epsilon$ of the steel surface of $\epsilon=0.06$ can be achieved:

$$\rightarrow P_S=0.06\cdot5.67\cdot10^{-8}\cdot8.10^{-3}\cdot(4734-3234)W=\underline{1.07W}$$

By coating the steel surface with gold, $\epsilon=0.02$ can be achieved:

$$\rightarrow P_s=0.06\cdot5.67\cdot10^{-8}\cdot8.10^{-3}(4734-3234)W=\underline{0.36W}$$

This is in accordance with a reduction of the heat radiation input of around 94% compared to steel surfaces.

The invention is based on reducing the heat irradiated from the cylinder head to the direct injector by reducing the degree of emission $\epsilon$ of injector surfaces associated with radiation and the cylinder head bore. This can be achieved by applying a thin surface coating of typically a few micrometer to the cylinder bore/injector installation space emitting the radiation and the outside contour 11 of the injector absorbing the radiation, which is for example applied by galvanizing, sputtering, vapor deposition, chemically or by flame spraying. Therefore, a plurality of techniques is well known; said techniques can be used for the coating process in each case.

An additional heat transfer, which should not be underestimated, takes place by heat flows in the heat flows aligned axially to the injector. The heat flows aligned in a radial manner in the direction of the direct injector have been discussed and minimized until now. However, there can be a high temperature gradient in the area of the contact surface of the injector. This is a metal-to-metal contact with a high thermal conductivity. Because of this, there is considerable heat at this point in extreme conditions such as, for example, the hot soak phase. Particularly in the case of high-performance engines, the heat conductance is considerable when there are large temperature differences in the direct injector.

Until now, the heat carried from the cylinder head to the injector has not been taken into consideration at this point.

Figure 4:
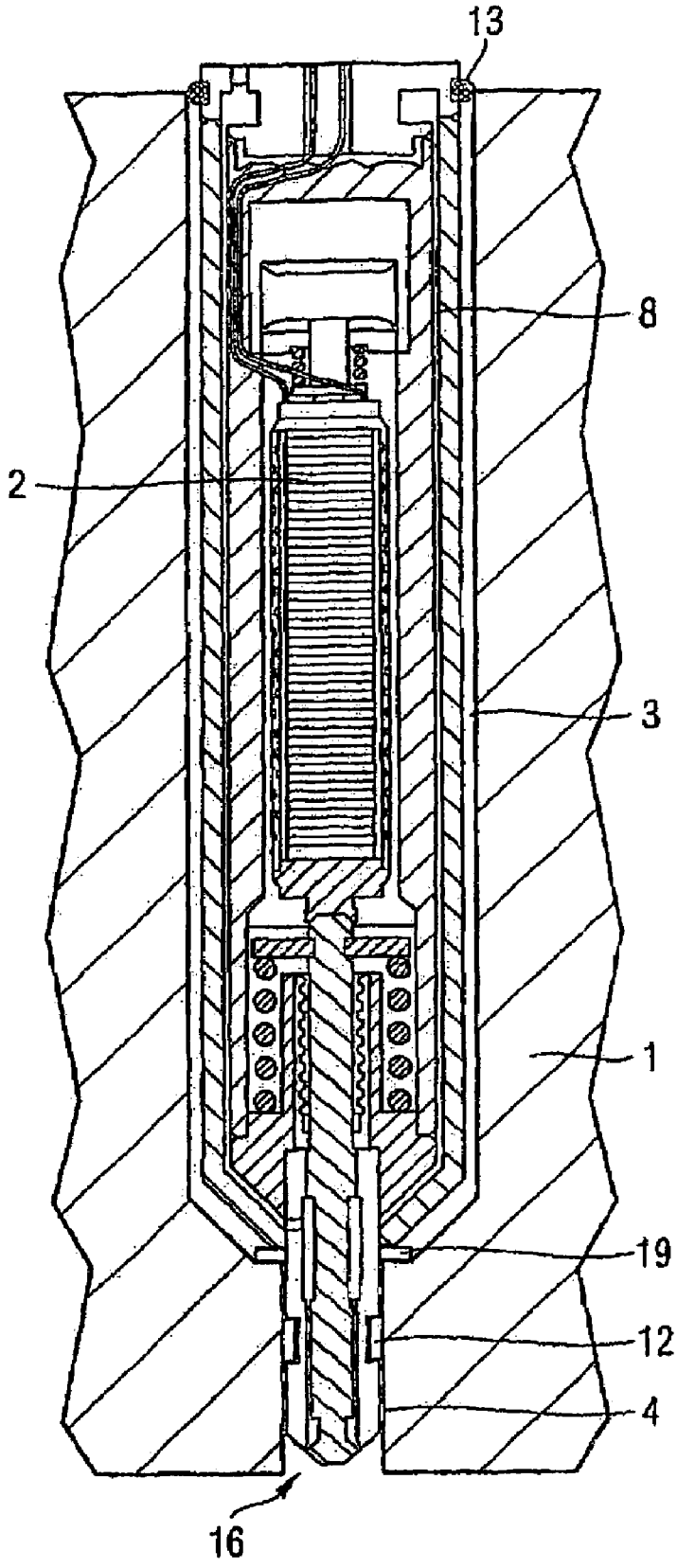
FIG. 4 shows an installation situation of an injector with a heat-insulating washer between the front side of the injector housing and a cross-section gap in the cylinder head.

FIG. 4 shows an installation situation of a piezoelectric direct injection valve. In the cylinder head 1, there is a suitably shaped bore, which accommodates the injector. Under realistic extreme conditions such as, for example, in the first seconds to minutes after a heavy-duty load phase, at present in the idle mode, for example, on stopping after having traveled on the highway, at a traffic light or on a hot soak, the direct injector takes on the fuel temperature, while the cylinder head 1 in the case of production model engines reaches maximum temperatures of up to 150° C. and in the case of racing car engines, up to 200° C. As a result, there is a steep temperature gradient in the contact surface of the injector on the corresponding area of the cylinder head 1 at the cross-section gap 7 (contact surface), which leads to a high heat flow in the injector and the associated heating of the fuel in this area.

The invention consists in installing a washer/insulating disc 19 of a thermally insulating material with a thermal conductivity of $\lambda<0.2$ W/m/K, which compared to structural steels or aluminum with a thermal conductivity of $\lambda=15$-220 W/m/K, has a strong thermal insulation action.

The washer should have a thickness of at least 0.5 mm. However, a thickness of approximately 2-5 mm should be aimed at in each case.

In addition, the insulating disc 19 should meet the minimum requirements such as, for example, a minimum thickness or a specific flow behavior because the injector, with a pressing mechanism with a pressing force of approximately 500-3000 N which is not shown in FIG. 4 is kept pressed against the contact area. The washer has to be dimensioned and suitable material selected in such a way that the washer is not damaged by the pressing force.

The insulating disc 19 should be sufficiently resistant to temperature. The material of the insulating disc 19 must be resistant to fuels and oils. Hard rubber, hard paper, polyamide, Teflon, epoxy resins and widely varying compounds such as CFK, GFK (synthetic materials reinforced with carbon fibers or glass fibers) are taken into consideration as materials.

In an advantageous way, the insulating disc 19 at the same time serves to reduce the oscillation of the injector because of engine vibrations and damage to the injector drive initiated because of this. Oscillations, which can be picked up from the engine, are greatly weakened by a relatively soft insulating disc 19 and transferred to the injector. The insulating disc 19 absorbs transverse oscillations based on the inner mechanical damping, which is higher compared to metals.

Figure 5:
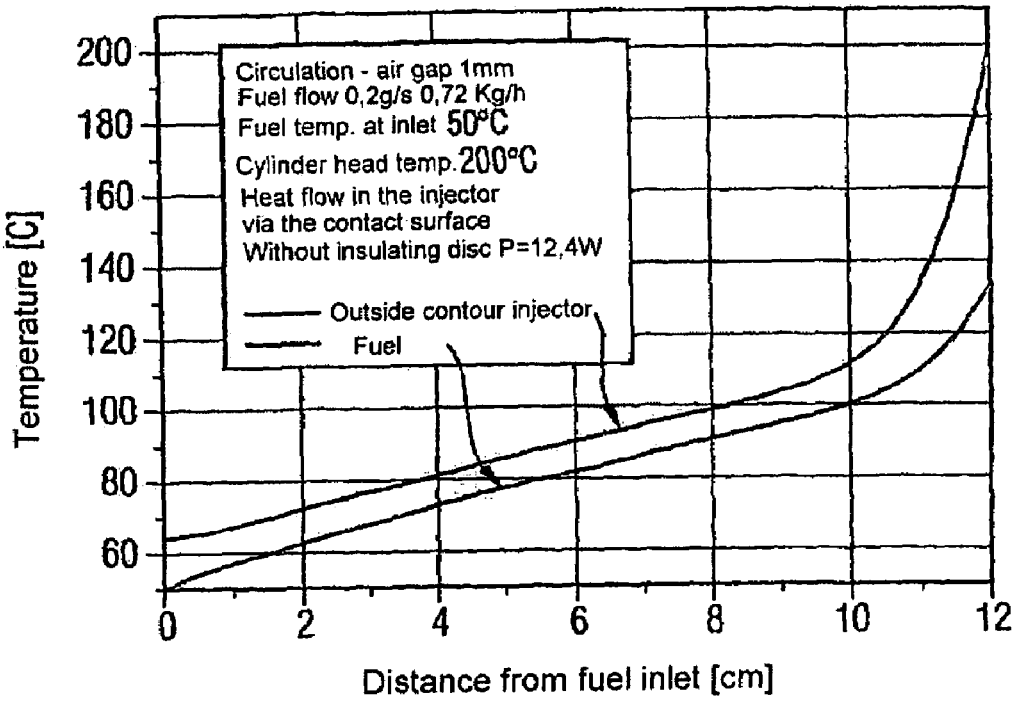
FIG. 5 shows the temperature curve in an injector without an insulating disc.
Figure 6:
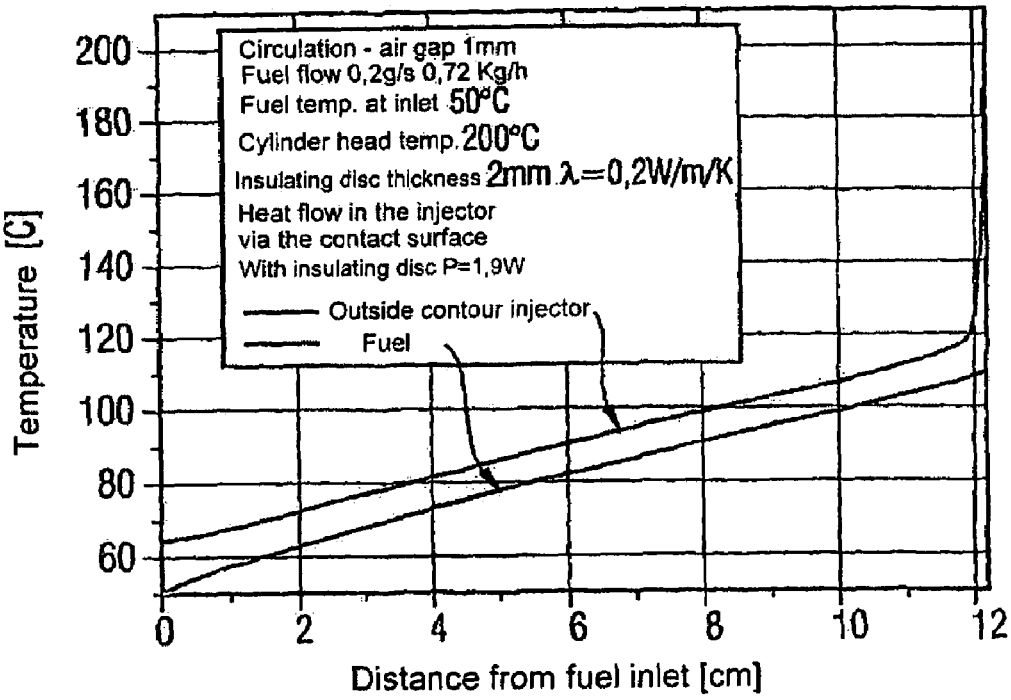
FIG. 6 shows the temperature curve in an injector with a heat-insulating disc.

Appraisal of the Efficiency in Extreme Operating Conditions:

From the comparison in FIG. 5, which shows the result of an orienting simulation for the fuel temperature and the temperature of the outside contour of the injector 11 as a function of the distance from the fuel inlet 10 without an insulating disc 19, together with FIG. 6, which shows the simulation result with an insulating disc 19, the efficiency of the insulating disc 19 with regard to the thermal insulation is in particular proved by:

the lower fuel final temperature of:

approximately 107° C. compared to that of approximately 130° C. without an insulating disc 19, and the heat flow across the contact surface of 1.9W compared to that of 12.4W without an insulating disc 19.

It is important, to bear in mind that the said simulation results in FIGS. 5 and 6 are calculated by neglecting the dissipated heat of the injector drive.

What is claimed is:

1. A direct injection valve in a cylinder head, having a cylindrical housing comprising the following components:

a valve aligned in the direction of a combustion chamber for dosing a fluid by means of a valve needle, an actuator for generating a stroke acting on the valve needle, a fluid supply from the back of the actuator to the valve, a cylindrical ring slot connecting the fluid supply with the valve and surrounding the actuator;

wherein in order to minimize the heat transfer from the cylinder head to the injection valve, metal-to-metal contact areas are separated from each other by means of an insulating material.

2. A direct injection valve according to claim 1, wherein the fluid supply is distributed evenly cross the circumference in the radial outer area of the direct injection valve.

3. A direct injection valve according to claim 1, wherein the insulating material consists of an insulating disc with a thickness of at least 0.5 mm.

4. A direct injection valve according to claim 3, wherein the insulating disc has a thickness of between 2 and 5 mm.

5. A direct injection valve according to claim 1, wherein the insulating disc is resistant to a temperature of at least up to 220° C.

6. A direct injection valve according to claim 1, wherein the insulating disc is resistant to corrosion, has a minimum thickness and does not flow.

7. A direct injection valve according to claim 1, wherein the insulating disc consists of one of the materials such as hard rubber, hard paper, polyamide, polytetrafluoroethylene (PTFE), epoxy resin or a compound such as synthetic materials reinforced with carbon fibers or glass fibers.

8. A direct injection valve according to claim 1, wherein the surface of a valve fitted in the combustion chamber in order to minimize the quantity of heat absorbed from the combustion chamber, is polished and/or made of a material with a low degree of emission $\epsilon$.

9. A direct injection valve according to claim 1, further comprising an annular groove coupled between the fluid supply and the cylindrical ring.

10. A direct injection valve according to claim 1, wherein the actuator is a piezo actuator arranged along a central axis of the direct injection valve.

* * * * *